US006010005A

United States Patent [19]

Reames et al.

[11] Patent Number: 6,010,005

[45] Date of Patent: Jan. 4, 2000

[54] SERVING TRAY

[75] Inventors: Gary Reames, Muskegon; Bob Herrmann, Spring Lake; Howard Daley, Zeeland, all of Mich.

[73] Assignee: Gemtron Corporation, Sweetwater, Tenn.

[21] Appl. No.: 09/223,306

[22] Filed: Dec. 30, 1998

[51] Int. Cl.[7] ..... B65D 1/34

[52] U.S. Cl. ..... 206/557; 220/602; 220/611; 220/642; D9/425; 99/422

[58] Field of Search ..... 206/557, 558, 206/559, 560, 561, 562, 563, 564; D9/425, 432; 220/602, 611, 612, 618, 684, 642, 648, 649; 99/422

[56] References Cited

U.S. PATENT DOCUMENTS

| | | | |
|---|---|---|---|
| 1,616,625 | 2/1927 | Howell | 220/648 |
| 2,097,073 | 10/1937 | Long | 428/552 |
| 2,210,183 | 8/1940 | Schweighart | 206/557 |
| 3,680,733 | 8/1972 | Winslow | 220/642 |
| 3,782,331 | 1/1974 | Huizinga | 119/269 |
| 5,273,354 | 12/1993 | Herrmann et al. . | |
| 5,934,472 | 8/1999 | Ramirez et al. | 206/557 |

FOREIGN PATENT DOCUMENTS

| | | | |
|---|---|---|---|
| 0215697 | 11/1984 | Germany | 220/602 |

*Primary Examiner*—Paul T. Sewell
*Assistant Examiner*—J. Mohandesi
*Attorney, Agent, or Firm*—Diller, Ramik & Wight, PC

[57] ABSTRACT

A serving tray includes a tempered glass panel of a predetermined peripheral configuration defined by a substantially continuous peripheral edge bounded by a one-piece injection molded polymeric/copolymeric synthetic plastic material encapsulation. The encapsulation includes upper and lower leg portions and a bight portion therebetween with an upper surface of the panel and the upper leg portion being in peripheral liquid-tight sealed engagement to define a liquid dam therebetween. Legs projecting beyond the lower leg portions space a lowermost decorative surface of the glass panel away from an adjacent stacked panel or an underlying supporting surface.

16 Claims, 5 Drawing Sheets

SERVING TRAY

BACKGROUND OF THE INVENTION

Conventional serving trays are manufactured from metal, plastic, wood or combinations thereof and may be decorated or not. Such conventional trays vary in configuration from circular trays utilized by cocktail waiters/waitresses for serving drinks, appetizers or the like to larger serving trays generally of a polygonal or rectangular configuration which are used for serving meals. Cafeteria trays represent the bottom line of such serving trays, both from a cost standpoint and from an aesthetic standpoint. At the high side are found silver serving trays. However, common to all such trays are certain basic requirements including, of course, a relatively flat, stable, substantially rigid supporting surface and a frame or border rising at least slightly above the supporting surface to function as a dam to prevent liquid from dripping off the supporting surface and onto floors, carpets, tables, upholstery, customers or the like.

Larger polygonal or rectangular serving trays also preferably include diametrically opposite gripping portions to facilitate carrying the serving tray under heavy loads. Nesting or stacking of such serving trays is also a desirable characteristic, as is the ability to resist breakage or damage during use or when being cleaned manually or by automatic machinery. Such trays should also be aesthetically appearing and should lend themselves to decorative enhancement absent degradation of the overall structure of the serving tray. Such serving trays also must lend themselves to having applied thereto selectively different decorations or artistic motifs to enhance sales to a different cross-section of customers, absent excessive storage and undesired extensive inventory control.

SUMMARY OF THE INVENTION

In keeping with the foregoing, a primary object of the present invention is to provide a novel serving tray utilizing a tempered glass panel of a predetermined peripheral configuration as defined by a substantially continuous peripheral edge to which is injection molded a frame or encapsulation of injection molded polymeric/copolymeric synthetic plastic material. In the simplest embodiment of the invention, the tempered glass panel is substantially entirely transparent, translucent or opaque and has the frame or frame-like encapsulation injection molded thereto such that in cross-section the encapsulation is defined by upper and lower generally parallel leg portions and a bight portion therebetween. The upper leg portion of the encapsulation defines a spill dam in the manner as that disclosed in commonly assigned U.S. Pat. No. 5,273,354 granted on Dec. 28, 1993. Thus, any liquid disposed upon the top surface of the tempered glass panel is contained by the upper leg portion of the encapsulation and cannot accidentally or inadvertently run or drip therefrom. Moreover, since the encapsulation is achieved through injection molding a liquid-tight seal is created about the entire peripheral edge of the tempered glass panel and the encapsulation which additionally prevents liquid from seeping therebetween thereby maintaining the integral rigidity and integrity of the panel and the encapsulation.

In lieu of a transparent, translucent or opaque tempered glass panel, the tempered glass panel can have a decorated surface which preferably is the lower surface of the tempered glass panel to prevent deterioration thereof, as would otherwise occur quite rapidly if the decoration were applied to an upper surface of the glass panel upon which glasses, plates, cups, etc. are supported and which would progressively wear away the decoration. By conventionally silk screening decorative material upon the bottom surface of the tempered glass panel and oven drying the same to a relatively indestructible nature, the serving tray can be utilized absent deterioration of such decorative material.

In-line stencil screening followed by oven drying is common in the production of glass panels, and by utilizing different stencil screens, different decorations can be applied to the tempered glass panels to satisfy customer demands. For example, so-called "souvenir" serving trays might be provided with seascapes for sale at shore resorts (Bar Harbor, Maine; Hilton Head, S.C., etc.), whereas mountain snow scenes might be utilized on similar trays destined for sale at ski resorts (Killington, Vt.; Vail, Colo., etc.). Thus, whatever "standard" serving trays to be manufactured, only one size of tempered glass need be utilized during production because decorations applied thereto can be varied quite quickly and inexpensively which, obviously, translates into minimum tempered glass panel inventories.

Since the frame is injection molded, it is a relatively simply proposition to "color coordinate" a particular injection molded frame or rim relative to a particular decoration or scene silk screen printed upon the tempered glass panel. For example, a decorative snow scene might be bordered by a white frame to attain maximum aesthetics, yet during the yuletide season, red resin or green resin might be utilized to form the injection molded frame to impart a more "festive" or "Christmas" feel to the serving tray. Such variations are readily achieved with minimum effort, inventory and cost.

The serving tray also preferably includes diametrically disposed handles or gripping portions, particularly in the case of relatively large serving trays.

The lower leg portion of the encapsulation, frame or rim is also provided with relatively short supporting legs, also formed during the injection molding operation, which permits the serving trays to be stacked absent damage to each other, to the decorations thereon, or to the supporting surface upon which any one tray might rest. When thus stacked, adjacent handles of stacked trays are readily accessible because of a gap created therebetween by the supporting feet which allows an uppermost of the serving trays to be readily grasped and removed from the next succeeding serving tray of the stack.

Additionally, in a second embodiment of the invention a lowermost surface of the tempered glass panel lies in the same plane as a lowermost surface of the lowermost leg of the encapsulation, rim or frame. This provides the serving tray with a minimum cross-sectional which allows more serving trays to be stacked per vertical height (storage) or horizontal spacing (automatic washing machine). Furthermore, the supporting legs project beyond the plane of the lower surface of the tempered glass panel and, thus, serves to protect the decoration thereon by the relative spacing achieved thereby.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
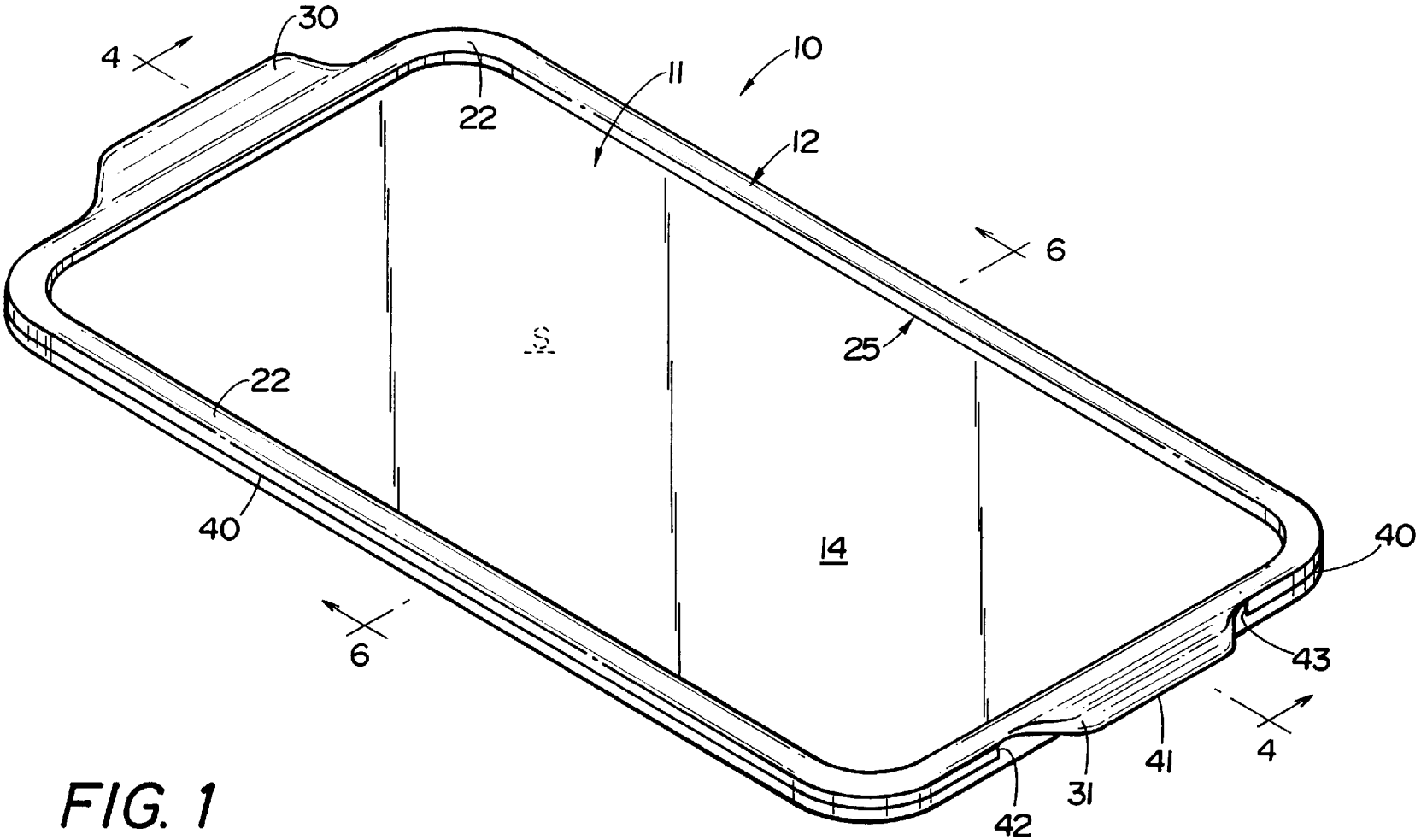
FIG. 1 is a top perspective view of a novel serving tray of the present invention, and illustrates a tempered glass panel bounded by a frame, rim or encapsulation of injection molded polymeric/copolymeric synthetic material with diametrically oppositely disposed handles and a peripheral parting line or line of flash bounding an exterior surface of the encapsulation.
Figure 2:
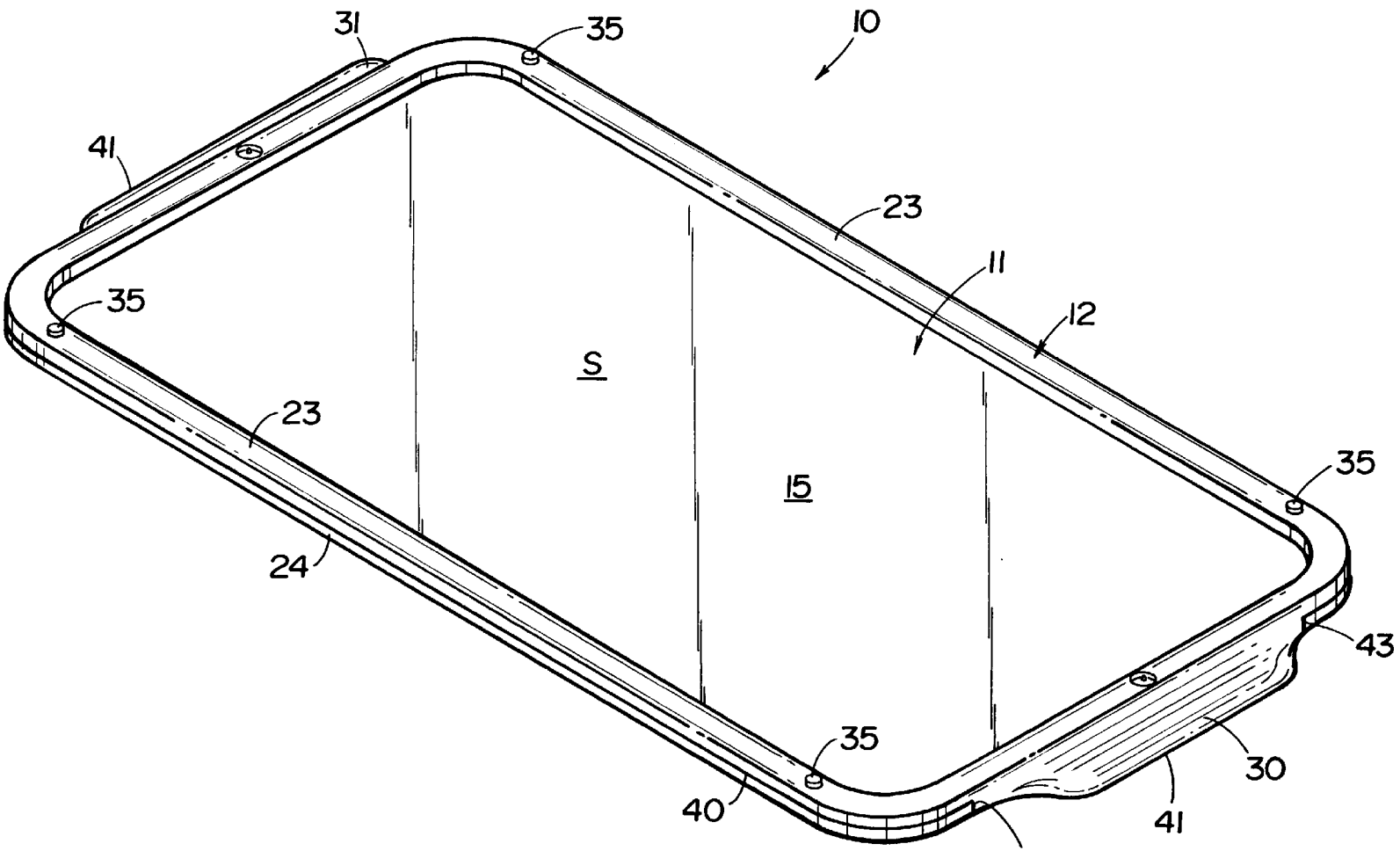
FIG. 2 is bottom perspective view of the serving tray of FIG. 1, and illustrates four relatively short supporting legs, each adjacent a corner of the encapsulation.

A novel serving tray constructed in accordance with this invention is fully illustrated in FIGS. 1 through 6 of the drawings and is generally designated by the reference numeral 10.

The serving tray 10 includes a tempered glass panel 11 and a rim, frame or encapsulation 12.

The tempered glass panel 11 is transparent and is of a predetermined peripheral configuration which is preferably polygonal or rectangular, though other peripheral configurations are considered to be within the spirit and scope of this invention. The peripheral configuration of the panel 11 is defined by a substantially continuous peripheral edge 13 (FIG. 6) which is substantially normal to an upper surface 14 and a lower surface 15 of the panel 11. The lower surface 15 is preferably provided with adecorative scenes, as by conventional silk screening and in-line oven baking. Since the glass panel 11 is preferably transparent in this embodiment of the invention, the decorative scene is readily viewed through the upper surface 14 thereof (FIG. 1).

Figure 6:
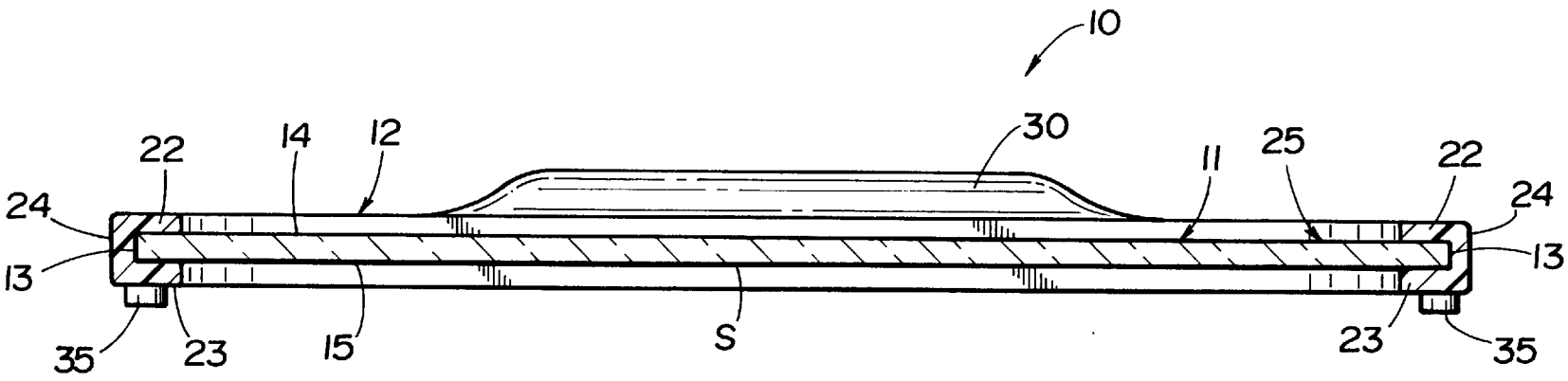
FIG. 6 is an enlarged cross-sectional view taken generally along line 6—6 of FIG. 1, and illustrates the peripheral edge of the tempered glass panel housed in a groove defined between the leg portion and bight portion of the encapsulation or frame.

The frame-like encapsulation 12 is injection molded to the overall configuration illustrated in the drawings and particularly the cross-sectional configuration illustrated in FIG. 6 by an injection molding process corresponding to those disclosed in U.S. Pat. Nos. 5,273,354; 5,362,145; 5,403,084; 5,429,433; 5,540,493; 5,441,338; 5,454,438; 5,524,981; 5,540,493; 5,564,809; 5,660,777; 5,705,113; 5,735,589 and 5,785,047, the disclosures of which are incorporated herein by reference with respect to the broader details of the manufacturing process. During the injection molding process, the frame, rim or encapsulation 12 is formed as a one-piece, substantially homogeneous injection molded synthetic plastic material member entirely encapsulating a peripheral portion (unnumbered) of the glass panel 11 including the peripheral edge 13 thereof and immediately adjacent upper and lower surface portions (unnumbered) of the respective upper and lower surfaces 14, 15. The encapsulation or frame 12 includes a pair of spaced leg portions 22, 23 (FIG. 6) and a bight portion 24 therebetween which collectively define a groove (unnumbered) whose surfaces (unnumbered) are in intimate liquid-tight sealed relationship to the opposing surfaces (unnumbered) of the portions 22, 23 and 24. This liquid-tight seal forms a peripheral dam 25 defined by the upper leg portion 22 and the upper surface 14 of the tempered glass panel 11 which contains spills, much in the manner more specifically described in U.S. Pat. No. 5,273,354.

Figure 3:
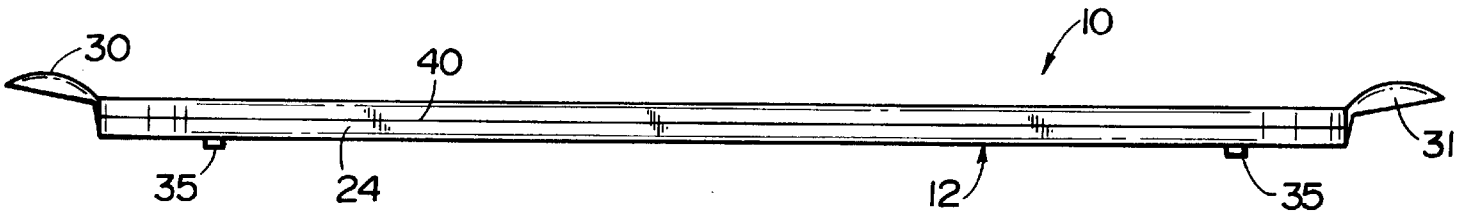
FIG. 3 is side elevational view of the serving tray of FIG. 1, and illustrates two of the supporting legs, the handles and the parting line or flash line along one side of the frame.
Figure 4:
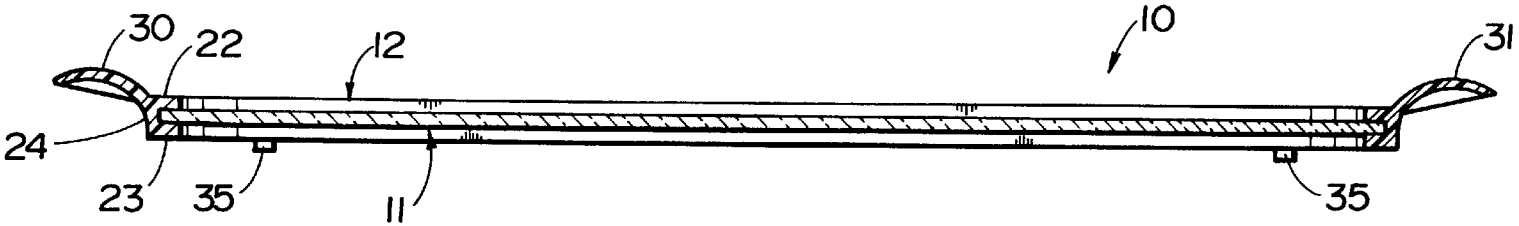
FIG. 4 is a longitudinal cross-sectional view taken generally along line 4—4 of FIG. 1, and illustrates a pair of generally parallel leg portions and a bight portion therebetween in sealed relationship to a peripheral edge of the tempered glass panel with an upper leg portion being sealed to an upper surface of the tempered glass panel and defining a liquid dam therewith.

During the injection molding process, the encapsulation 12 is formed with integral diametrically opposite handle means 30, 31 of a generally concavo-convex configuration opening in a downward direction, as is best viewed in FIGS. 3 and 4 of the drawings.

During the same injection molding process, the encapsulation 12 is provided with supporting means in the form of four relatively short cylindrical legs 35, one at each corner (unnumbered) of the serving tray 10 for elevating the serving tray 10 above a supporting surface and thereby protecting the decorations on the surface 15 of the tempered glass panel 11. The legs 35 also maintain a plurality of the trays 10 in relatively spaced stacked relationship to each other which is advantageous in maintaining the superimposed handles 30, 31 spaced a like distance from each other to define a gap between the uppermost tray and the next lowermost tray which facilitates the grasping of the handles 30, 31. This eases the removal of each uppermost tray 10 from the stack, as might be done, for example, incident to moving along a cafeteria line. The legs 35 also create similar spacing when the serving trays 10 are stacked vertically, as is often times done in automatic washing machines.

Figure 5:
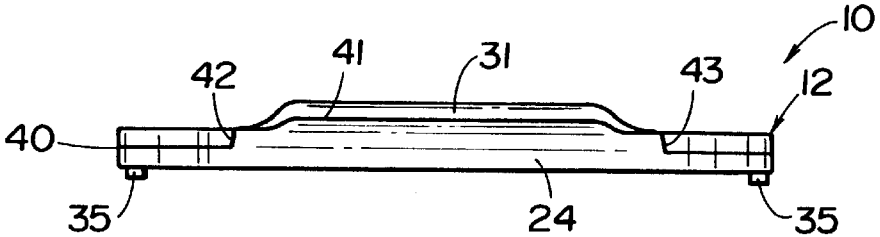
FIG. 5 is an end view of the serving tray looking from right-to-left in FIG. 1, and illustrates an offset portion of the parting line along one of the handles.

The cavity (not shown) of the two-piece mold (also not shown) within which the tempered glass panel 11 is seated incident to the injection molding operation defines a parting line when closed which lies essentially in a plane passing midway through the surfaces 14, 15 (FIG. 6). This parting line or parting plane forms a minute parting line or line of flash 40 (FIG. 1) along the bight portion 24 of the frame which at each of the handles 30, 31 includes an offset parting line portion 41 (FIG. 5) running along the outermost edge of each of the handles 30, 31 and subsequently uniting or joining the overall parting line 40 at upright parting line portions 42, 43 (FIG. 5). It is along the parting line 40 and the parting line portions (41 through 43) that the mold halves separate to permit the insertion of the tempered glass panel 11 therebetween, the eventual molding of the frame or encapsulation 12, the opening of the mold bodies, and the removal of the serving tray 10 from the mold cavity (not shown). The latter effects the formation of a substantially rigid one-piece frame 12, including the opposite handles 30, 31 thereof and assures sufficient rigidity to prevent the serving tray 10 from torquing or bending under load thereby maintaining the sealed relationship heretofore described and, thus, maintain the integrity of the liquid dam 25.

Figure 7:
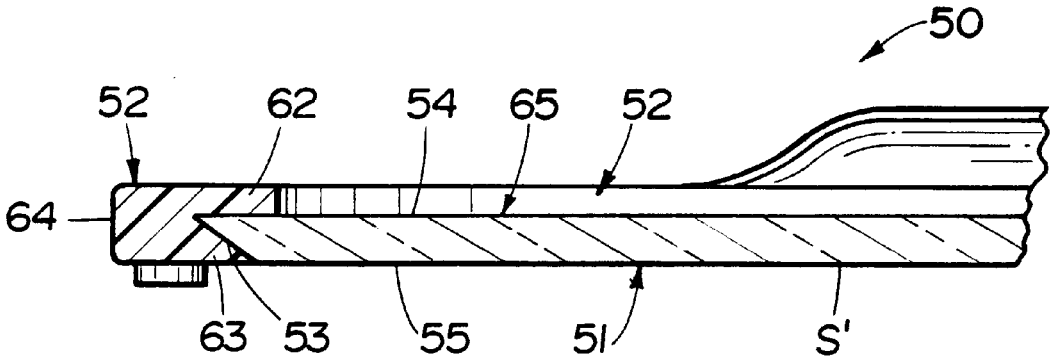
FIG. 7 is a fragmentary cross-sectional view taken through another serving tray along a line corresponding to the line 6—6 of FIG. 1, and illustrates an undercut interlocked juncture between a peripheral edge of a tempered glass panel and an injection molded encapsulation or frame.

Another serving tray constructed in accordance with this invention is illustrated in FIG. 7 of the drawings, and is generally designated by the reference numeral 50.

The serving tray 50 is similar to the serving tray 10 and includes a tempered glass panel 51 and a rim, frame or encapsulation 52.

The tempered glass panel 51 is transparent and is of a predetermined peripheral configuration, such as that described heretofore relative to the tempered glass panel 51. The peripheral configuration of the panel 51 is defined by a substantially contiguous peripheral edge 53 which defines an included acute angle (unnumbered) with respect to an upper surface 54 and an included obtuse angle (unnumbered) with respect to a lower surface 55 of the panel 51. The lower surface 55 is also preferably provided with a decorative scene S', again preferably by conventional silk screening and in-line oven baking.

The frame-like encapsulation 52 is injection molded in the manner heretofore described and includes a pair of spaced leg portions 62, 63 and a bight portion 64 therebetween collectively defining a groove (unnumbered) whose two surfaces (unnumbered) define the acute angle and are in intimate liquid-tight sealed relationship to the opposing surfaces of the leg portions 62, 63. This liquid-tight seal forms a peripheral dam 65 defined by the upper leg portion 22 and the upper surface 54 of the glass panel 51 which contains spills in the manner heretofore described.

During the injection molding of the encapsulation 52, the undercut juncture between the lower leg portion 63 and the peripheral edge 53 of the panel 51 serves to interlock the encapsulation 52 to the glass panel 51. Additionally, the plane of the lower surface 55 and a lowermost surface (unnumbered) of the leg portion 53 are common to each other and projecting therebelow is one of four legs 66. The legs 66 thus space the decoration S' from other underlying stacked trays 50 or from any underlying supporting surface to prevent decoration deterioration.

Although a preferred embodiment of the invention has been specifically illustrated and described herein, it is to be understood that minor variations may be made in the apparatus without departing from the spirit and scope of the invention, as defined the appended claims.

What is claimed is:

1. A serving tray comprising a tempered glass panel of a predetermined peripheral configuration defined by a substantially continuous peripheral edge, said panel further including upper and lower surfaces bridged by said peripheral edge, a peripheral portion of said panel being defined by said peripheral edge and immediately adjacent upper and lower surface portions of said respective upper and lower surface portions of said respective upper and lower surfaces, a frame-like encapsulation of one-piece injection molded polymeric/copolymeric synthetic plastic material entirely encapsulating said panel peripheral portion including said peripheral edge and said immediately adjacent upper and lower surface portions of said respective upper and lower surfaces, said panel peripheral portion further including a pair of spaced leg portions and a bight portion therebetween defining a substantially continuous inwardly opening channel within which is seated said panel peripheral portion, said bight portion including at substantially diametrically opposite locations handle means for grasping said serving tray, a lowermost of said leg portions including means for supporting said tray upon a supporting surface with said panel lower surface in spaced relationship to said supporting surface, and an uppermost of said pair of leg portions defining a substantially continuous unbroken peripheral dam in liquid-tight sealing relationship to said panel upper surface thereby preventing spillage upon said panel upper surface from spilling therefrom.

2. A serving tray as defined in claim 1 including a peripheral parting line extending substantially continuously along an exterior surface of said bight portion and an exterior surface of said handle means.

3. The serving tray as defined in claim 1 wherein said supporting means are a plurality of spaced feet.

4. The serving tray as defined in claim 1 wherein said panel lower surface and a lower surface of said lowermost leg portion are located in a common plane.

5. The serving tray as defined in claim 1 wherein said panel peripheral edge is disposed at an acute included angle to one of said panel upper and lower surfaces and at an obtuse included angle to the other of said panel upper and lower surfaces.

6. The serving tray as defined in claim 2 wherein said panel lower surface and a lower surface of said lowermost leg portion are located in a common plane.

7. The serving tray as defined in claim 2 wherein said panel peripheral edge is disposed at an acute included angle to one of said panel upper and lower surfaces and at an obtuse included angle to the other of said panel upper and lower surfaces.

8. The serving tray as defined in claim 4 wherein said panel peripheral edge is disposed at an acute included angle to one of said panel upper and lower surfaces and at an obtuse included angle to the other of said panel upper and lower surfaces.

9. The serving tray as defined in claim 6 wherein said panel peripheral edge is disposed at an acute included angle to one of said panel upper and lower surfaces and at an obtuse included angle to the other of said panel upper and lower surfaces.

10. A serving tray comprising a tempered glass panel of a predetermined peripheral configuration defined by a substantially continuous peripheral edge, said panel further including upper and lower surfaces bridged by said peripheral edge, a peripheral portion of said panel being defined by said peripheral edge and immediately adjacent upper and lower surface portions of said respective upper and lower surface portions of said respective upper and lower surfaces, a frame-like encapsulation of one-piece injection molded polymeric/copolymeric synthetic plastic material entirely encapsulating said panel peripheral portion including said peripheral edge and said immediately adjacent upper and lower surface portions of said respective upper and lower surfaces, said panel peripheral portion further including a pair of spaced leg portions and a bight portion therebetween defining a substantially continuous inwardly opening channel within which is seated said panel peripheral portion, said bight portion including at substantially diametrically opposite locations handle means for grasping said serving tray, a lowermost of said leg portions including means for supporting said tray upon a supporting surface with said panel lower surface in spaced relationship to said supporting surface, an uppermost of said pair of leg portions defining a substantially continuous unbroken peripheral dam in liquid-tight sealing relationship to said panel upper surface thereby preventing spillage upon said panel upper surface from spilling therefrom, and said panel lower surface and a lower surface of said lowermost leg portion are located in a common plane.

11. A serving tray as defined in claim 10 including a peripheral parting line extending substantially continuously along an exterior surface of said bight portion and an exterior surface of said handle means.

12. The serving tray as defined in claim 10 wherein said supporting means are a plurality of spaced feet.

13. The serving tray as defined in claim 10 wherein said panel peripheral edge is disposed at an acute included angle to one of said panel upper and lower surfaces and at an obtuse included angle to the other of said panel upper and lower surfaces.

14. A serving tray comprising a tempered glass panel of a predetermined peripheral configuration defined by a substantially continuous peripheral edge, said panel further including upper and lower surfaces bridged by said peripheral edge, a peripheral portion of said panel being defined by said peripheral edge and immediately adjacent upper and lower surface portions of said respective upper and lower surface portions of said respective upper and lower surfaces, a frame-like encapsulation of one-piece injection molded polymeric/copolymeric synthetic plastic material entirely encapsulating said panel peripheral portion including said peripheral edge and said immediately adjacent upper and lower surface portions of said respective upper and lower surfaces, said panel peripheral portion further including a pair of spaced leg portions and a bight portion therebetween defining a substantially continuous inwardly opening channel within which is seated said panel peripheral portion, said bight portion including at substantially diametrically opposite locations handle means for grasping said serving tray, a lowermost of said leg portions including means for supporting said tray upon a supporting surface with said panel lower surface in spaced relationship to said supporting surface, and an uppermost of said pair of leg portions defining a substantially continuous unbroken peripheral dam in liquid-tight sealing relationship to said panel upper surface thereby preventing spillage upon said panel upper surface from spilling therefrom, and said panel peripheral edge being disposed at an acute included angle to one of said panel upper and lower surfaces and at an obtuse included angle to the other of said panel upper and lower surfaces.

15. A serving tray as defined in claim 14 including a peripheral parting line extending substantially continuously along an exterior surface of said bight portion and an exterior surface of said handle means.

16. The serving tray as defined in claim 14 wherein said supporting means are a plurality of spaced feet.

* * * * *